US006277322B1

(12) United States Patent
Lotz

(10) Patent No.: US 6,277,322 B1
(45) Date of Patent: Aug. 21, 2001

(54) DEBURRING APPARATUS

(75) Inventor: Horst K. Lotz, Hofheim-Wallau (DE)

(73) Assignee: Gega Corporation, Pittsburgh, PA (US)

( * ) Notice: Subject to any disclaimer, the term of this patent is extended or adjusted under 35 U.S.C. 154(b) by 0 days.

(21) Appl. No.: 09/519,769

(22) Filed: Mar. 7, 2000

(30) Foreign Application Priority Data

Mar. 8, 1999 (EP) ..... 99104562

(51) Int. Cl.[7] ..... B23K 7/06
(52) U.S. Cl. ..... 266/51; 266/77; 266/48
(58) Field of Search ..... 266/48, 50, 51, 266/77

(56) References Cited

U.S. PATENT DOCUMENTS

| | | | |
|---|---|---|---|
| 2,521,199 | 9/1950 | Babcock . | |
| 3,377,896 | 4/1968 | De Corta . | |
| 3,515,029 | 6/1970 | Gambini . | |
| 4,357,817 | 11/1982 | Linsinger . | |
| 4,362,448 | 12/1982 | Hasebe et al. . | |
| 4,672,726 | 6/1987 | Delbecq et al. . | |
| 4,704,241 | 11/1987 | Boggs . | |
| 5,179,772 | 1/1993 | Braun et al. . | |
| 5,253,398 | 10/1993 | Markiewicz . | |
| 5,259,440 | 11/1993 | Lotz et al. . | |
| 5,312,091 * | 5/1994 | Vorgin | 266/51 |
| 5,597,030 | 1/1997 | Lotz . | |
| 5,626,181 | 5/1997 | Lotz . | |
| 5,765,271 * | 6/1998 | Lotz et al. | 409/300 |

FOREIGN PATENT DOCUMENTS

| | | |
|---|---|---|
| 2449137 | 4/1976 | (DE) . |
| 3116946 A1 | 12/1982 | (DE) . |
| G8225699.3 | 12/1982 | (DE) . |
| G8326005.6 | 2/1984 | (DE) . |
| G8412636.1 | 8/1984 | (DE) . |
| G8501244.0 | 6/1985 | (DE) . |
| G 84 24 289.2 | 10/1985 | (DE) . |
| 0198768 A1 | 6/1987 | (DE) . |
| 3700207 A1 | 7/1988 | (DE) . |
| 89106717.5 | 4/1989 | (DE) . |
| 93113128.8 | 8/1993 | (DE) . |
| 0 463 201 A1 | 11/1993 | (DE) . |
| 0392043B1 | 8/1994 | (DE) . |
| EP0980728A1 | 10/1998 | (DE) . |
| 0 240 130 | 7/1987 | (EP) . |
| 0 672 487 B1 | 1/1997 | (EP) . |
| 0 671 230 B1 | 5/1997 | (EP) . |
| 56-21712(A) | 2/1981 | (JP) . |
| 58-71022(A) | 4/1983 | (JP) . |
| SU 1389946 A1 | 4/1988 | (RU) . |

* cited by examiner

*Primary Examiner*—Scott Kastler
(74) *Attorney, Agent, or Firm*—Brij K. Agarwal; Eckert Seamans Cherin & Mellot, LLC

(57) ABSTRACT

An oxygen cutting machine (1) is designed for a billets, blooms, slabs or heavy plates in a pair of up and down arranged rails (3) having a novel heat protection plate (6) and no uncooled machine parts below the rails (3), which moves sideways with a drifting work-piece (2) being a clamping system, having a clamp down skid (10) to cover various thickness of work-piece (2) and can be used with so-called cutting push bars (24) for cutting against each other of two oxygen cutting burners (9). A new oxygen cutting burner (9) or nozzle quick exchange system improves use and maintenance. Cutting safety and cut quality are improved by the gas control for pressures and mass flow near the burners. A novel roll deburrer (32) to deburr just oxygen cut strand pieces (2) after the oxygen cutting machine (1) facilitates the to and fro deburring and the transport of extremely short pieces over the deburrer gap.

29 Claims, 18 Drawing Sheets

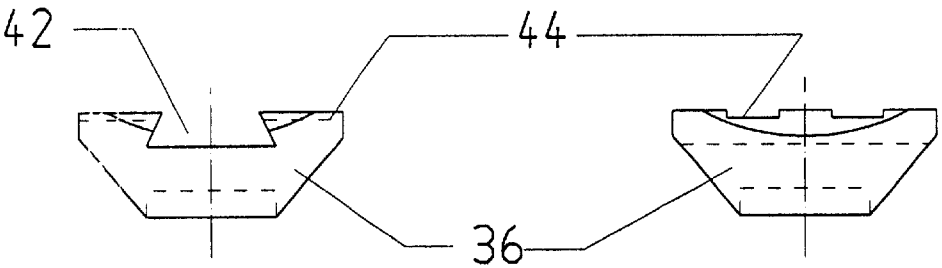
FIG. 26
FIG. 27
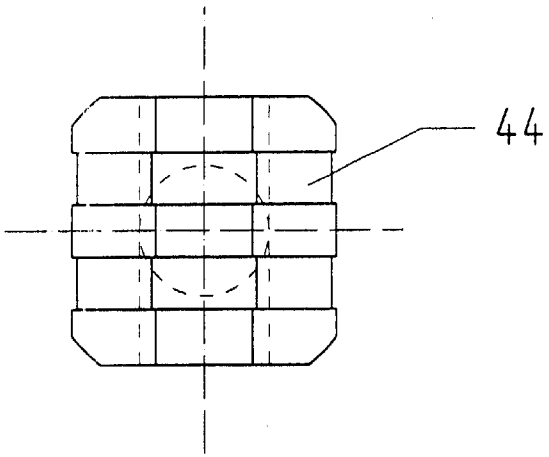
FIG. 28

DEBURRING APPARATUS

TECHNICAL FIELD

Continuous casting plant for billets, blooms and slabs with a subdividing and deburring plant for safe, maintenance favourable and quick production of shortest and burr free work pieces, arranged directly or later in the production flow.

BACKGROUND OF THE INVENTION

In casting operations for billets, blooms, and slabs, it is known that the workpiece extending from the casting plant must be cut into more manageable workpieces that are of a given length. Among the equipment for cutting the workpieces are oxygen-cutting burners that include oxygen-cutting nozzles. During the cutting operation with an oxygen-cutting burner, a burr typically is formed at the lower end of the workpieces in the vicinity of the cut. Such burrs are preferably removed from the workpieces prior to subsequent handling.

It is also known that the casting operation takes place in a harsh environment having elevated temperatures. It is thus desired to provide a cutting machine for cutting billets, blooms, and slabs that is operable in the typical harsh environment and that may include the capability of removing burrs from cut workpieces.

SUMMARY OF THE INVENTION

In view of the foregoing, an apparatus for cutting and deburring workpieces from a metal strand includes upper and lower tracks, with a frame being mounted on the upper and lower tracks, the lower track being liquid cooled, and with an oxygen-cutting machine being disposed on the frame. The apparatus may further include an upper wheel and a lower wheel that are mounted on the frame and that are rollably disposed against the upper and lower tracks, respectively. The apparatus may still further include a first gas deburring device that is mounted on the frame and a second deburring device that is structured to operatively interact with the workpieces.

An aspect of the machine is to provide an apparatus for the cutting and deburring of workpieces from a metal strand.

Another aspect of the present invention is to provide an apparatus that is suited to the harsh environment of a metal casting operation.

BRIEF DESCRIPTION OF THE DRAWINGS

FIG. 13 is a view similar to FIG. 7, except partially cut away;

FIG. 26 is a front elevational view of a third type of chisel cap in accordance with the present invention;

FIG. 27 is a side view of the third type of chisel cap;

FIG. 28 is a top plan view of the third type of chisel cap;

DESCRIPTION OF THE PREFERRED EMBODIMENTS

Figure 1:
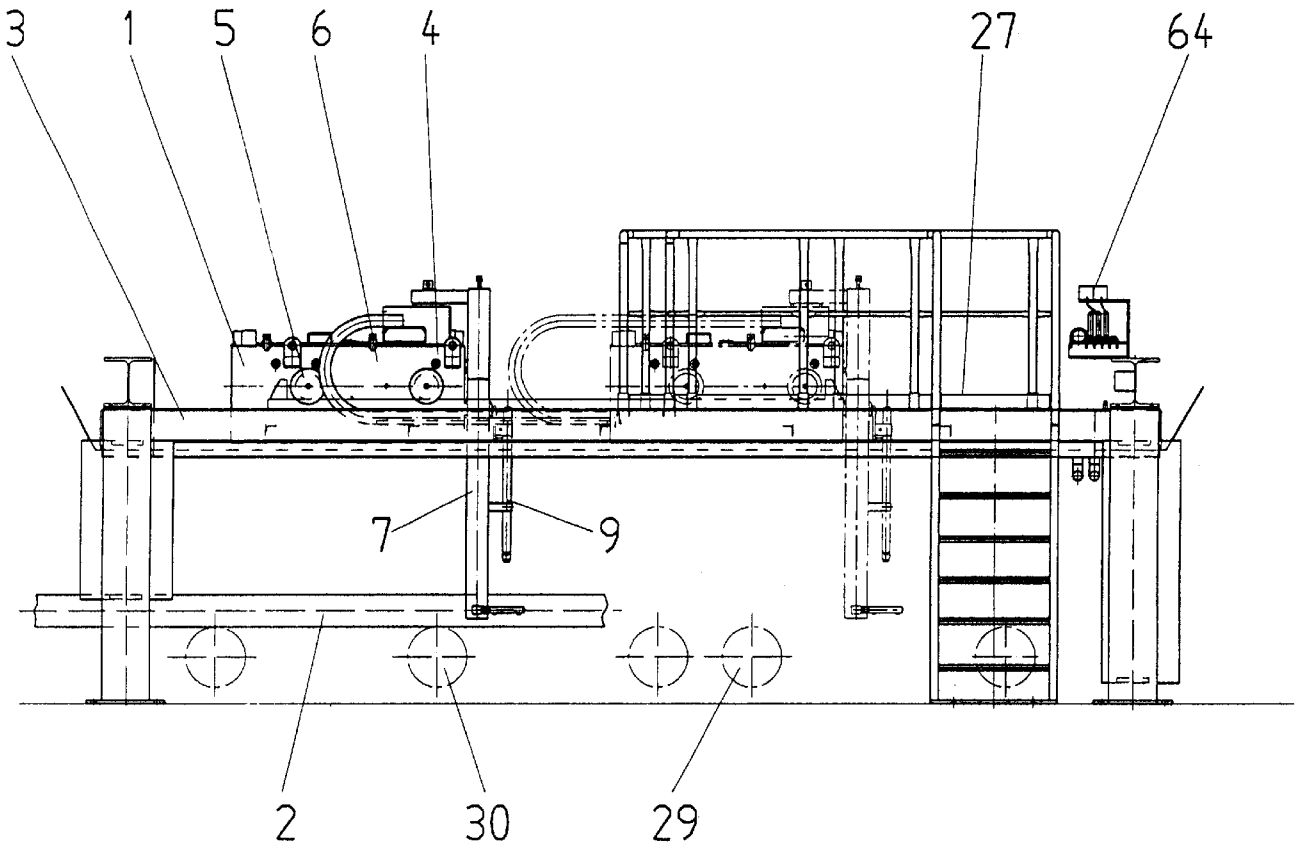
FIG. 1 PRIOR ART
FIG. 1 is a front elevational view of a prior art deburring apparatus.
Figure 4:
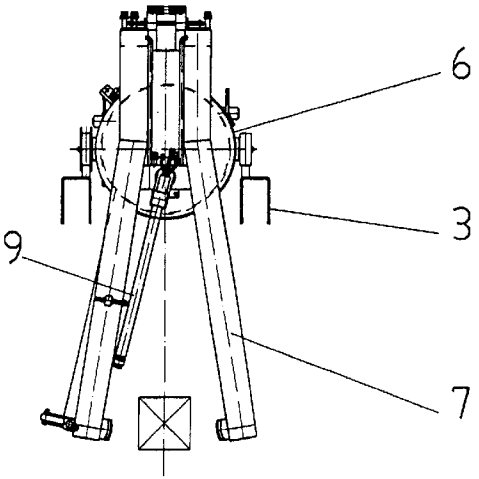
PRIOR ART FIG. 4
FIG. 4 is a view of the prior art apparatus taken in the direction of the arrow X of FIG. 2.

Continuous casting plant for billets, blooms and slabs with a subdividing and deburring plant for safe, maintenance favourable and quick production of shortest and burr free work pieces, arranged directly or later in the product flow. Since the beginning of industrially usable continuous steel strand casting the otherwise endless strands, which cannot be further treated in the normal production flow, the oxygen cutting has a key importance to produce shorter and easier treatable strand pieces (2) especially with bigger strand sections. Depending on the oxygen cutting machine (1) for dividing billets, blooms, bigger profiles, slabs or heavy plate, the designs are absolutely different despite the same or very similar cutting tools, i.e. oxygen cutting burner (9) with oxygen cutting nozzles (22), because of work piece dimensions, heat radiation, strand movements and speeds, strand distances and other plant circumstances. As well the type and arrangement of the equipment for a gas technical or mechanical elimination of the cutting burr or beads consisting of iron and iron oxides, developing at the lower respectively upper edges during the burning cutting with oxygen. Moreover these devices or machines are not very far developed. Therefore a new family of oxygen cutting machines is presented in the following description, which offers comparatively substantial advantages in the areas of operational safety and reliability, easy maintenance, operational speeds and efficiency depending on the comparison subjects in their alternatives as state of the art. For a better understanding the invention is presented in its alternatives using typical members of the family.

To produce burr free billet strand pieces or billets (2) oxygen cutting machines (1) as basically shown in FIGS. 1–4 are, which travel with the strand on one as two travelling tracks (3) arranged besides the strand. Predominantly they have an encompassing, closed machine frame or machine carriage (4) and travel with 3 or 4 wheels on correspondingly wide, mostly two rail tracks (3) or they travel on a narrow track (3) surrounded by correspondingly many travelling, guiding and supporting wheels on the machine carriage or frame (4). By that the machine carriage or frame (4) is rather wide, compact, closed or as well too complicated and therefore to difficult for maintenance access, as they as well have rather big heat protection panelling for their size and sensibility, which has to be opened and removed if necessary. As an example an successful allround water-cooled oxygen cutting machine (1) is shown. The requirement for cooling agent for the track (3) and the machine housing (4) is very big. The clamping levers (7) working in a scissor like fashion are positioned with the horizontally acting clamping cylinder (8) like the oxygen cutting burner (9) at the machine carriage (4) on its exit side of the strand (2). Opposite to that, basically shown in FIGS. 5–7A the oxygen cutting machine is narrower and costwise better producable as a not closing-in machine frame (4) between a lower water-cooled, narrow track (3) and an upper guiding and travelling track (3), which has been available so far but for a lesser, secondary task—but only now is used for the machine guiding itself, in order to produce a lighter and narrower oxygen cutting machine (1), which nevertheless is solid and well heat protected and allows new design possibilities. For once the bigger distance between the lower and the upper track (3) gives a better support and a better accessibility to the machine interior and allows a narrower design and with that an even better accessibility for maintenance purposes. Otherwise the narrow oxygen cutting machine (1) is better and more directly protected by the lower, water-cooled track (3) against the radiant heat of the strand (2) and the cooling condition of the oxygen cutting machine itself is simplified and improved by the integration of this track (3) into the panelling system. The elements necessarily protruding from the oxygen cutting machine (1), like clamping levers (7), respectively clamp down skid (10) and burner arm (11) respectively oxygen cutting burner (9) are water-cooled themselves or are heat insensitive and can encompass the lower track (3) without disadvantages. This has on its sides or at its lower surface no extra travelling rails or travelling faces.

Figure 10:
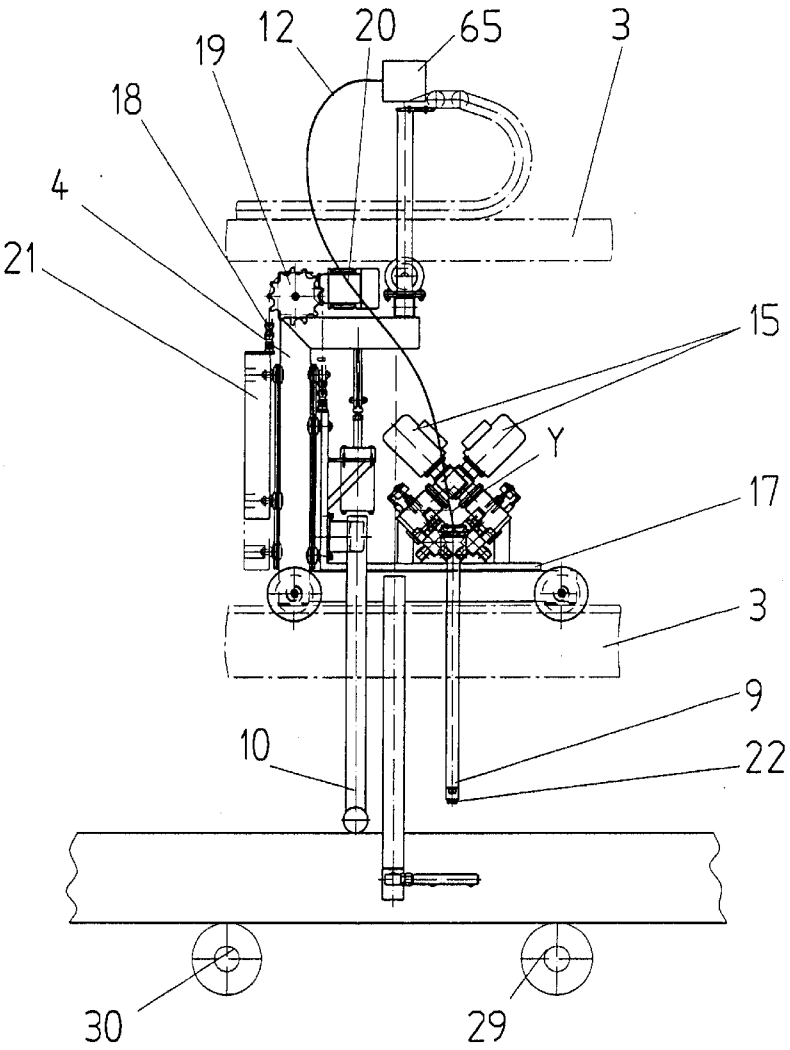
FIG. 10 is a view similar to FIG. 6, except showing a third configuration of a portion of the apparatus in accordance with the present invention.
Figure 11:
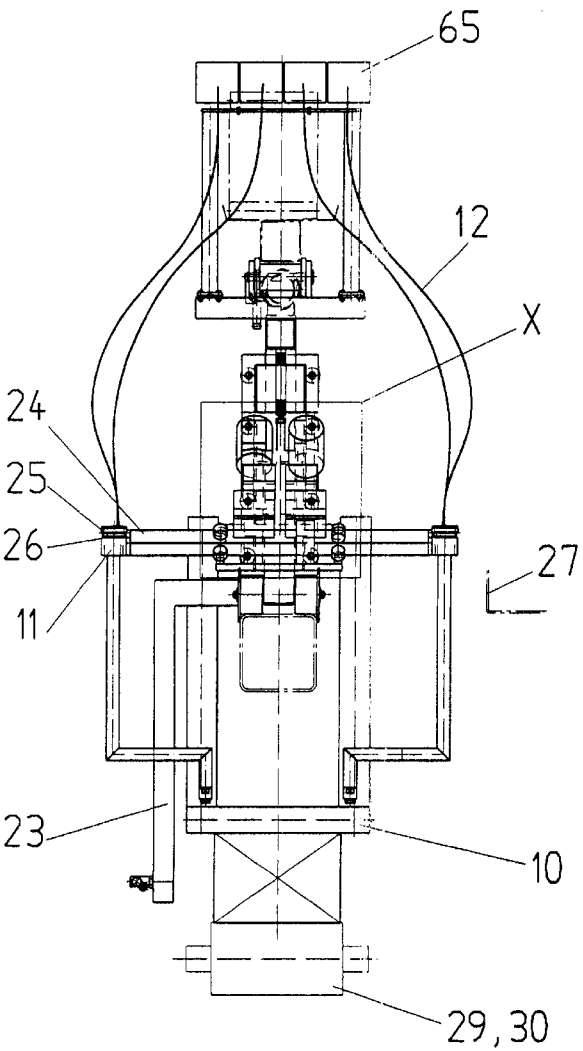
FIG. 11 is a view similar to FIG. 7, except showing a third configuration of a portion of the apparatus in accordance with the present invention.
Figures 12, 14, 15:
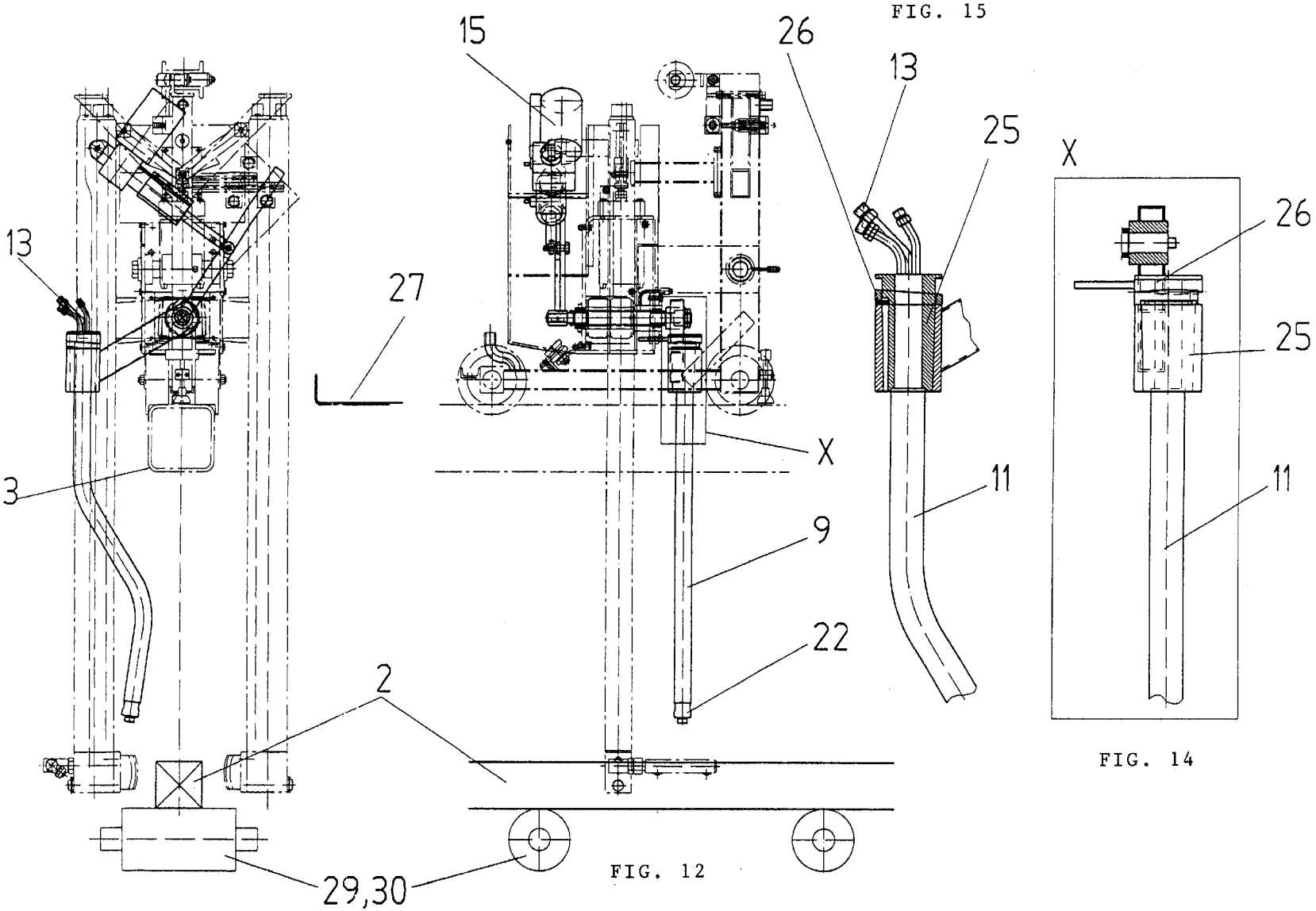
FIG. 12 is a view similar to FIG. 6, except partially cut away.
FIG. 14 is an enlarged view of the portion of FIG. 12 enclosed by the box X.
FIG. 15 is a right side view of the subject matter depicted in FIG. 14 partially cut away.

The subdividing and deburring plant in the area of the oxygen cutting machine (1) should be equipped with devices for the gas and oxygen control, arranged at the entrance of the utilities supply as close as possible to the machine on its oxygen cutting burner (9) should ensure an insensitive but operational suitable heating flame. Until now so-called mass-flow controller (64) or valves for heating gas and heating oxygen per burner, as shown in FIG. 10 according to EPA 91100300.2, are successfully integrated into the gas control panels before the machine i.e. at the operation platform to balance pressure fluctuation in the works mains automatically in a limited range and helps by that to avoid a continuous and complicated re-adjustment with a valve spindle (66) as an example. Do the changes of the pre-pressures repectively of the cutting oxgen nozzle (22) condition exceed the balancing possibilities of a mass flow controller (64) of about 20%, and does this even appear during a casting operation, then a remote control possibility of the mass flow controller (64) via its diaphragm (65) by a gaseous medium and its changes of control pressure is of undescribable advantage. For this the solenoid valve is doubled and short pre-pressure impulses from the entrance to the diaphragm (65) are initiated or a release using the exit side solenoid valve is effected. The utilities supply is performed through piping in the interior of the water-cooled burner arm (11) on the end of which in a more or less more protected area not as well protected hoses (12) and the diaphragm equipped mass flow controllers (64) are installed; at the lower end only short, insensitive metal piping is arranged for connection with the oxygen cutting burner (9). On oxygen cutting burners (9) moving pendulum like for instance with a fixing cone the diaphragm mass flow controllers (64) are installed directly or at the end of the utilities supply system in front of it. Rotating forces in the size appearing with an oxygen cutting machine (1) encompassing the track (3) with its travelling system, by the clamping or down clamping and by the sideways motions of the strand, are considerably reduced by the use of a second upper track (3). On top or at the upper track (3) a guiding, a tray or other equipment for the utilities supply i.e. with hoses and cables can be arranged including as well a holder or a pusher dog fastened to the oxygen cutting machine (1). It is reasonable to fix various control devices and containers here for various utilities like gases, water and iron powder. An adaption and sideways motion of the clamping and of the oxygen cutting system to or according to the present position of the strand (2) by a shiftable saddle (14) especially arranged in the machine frame (4), not only reduces the side forces onto the travelling system, but it facilitates the important and exact positioning of the oxygen cutting burner (9) for initial cutting and the exact finishing of the cutting on the cut exit side. The always exact position of the cutting drive (15) above the middle of the strand helps in comparison to other systems the full use of the maximum possible cutting speeds without consideration of the relative speeds appearing otherwise by the sideways motions of the strand (2).

Figure 7A:
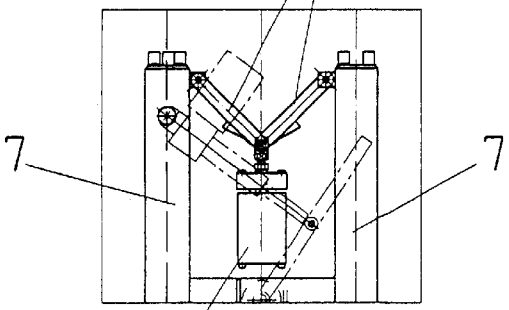
FIG. 7A is an enlarged view of the portion of FIG. 7 enclosed by the box X.
Figure 6:
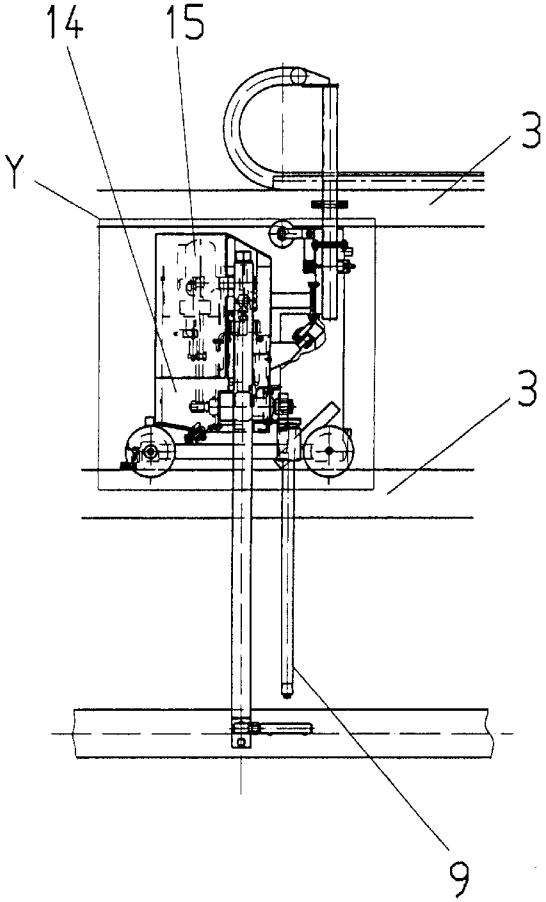
FIG. 6 is an enlarged view of a portion of FIG. 5.
Figure 7:
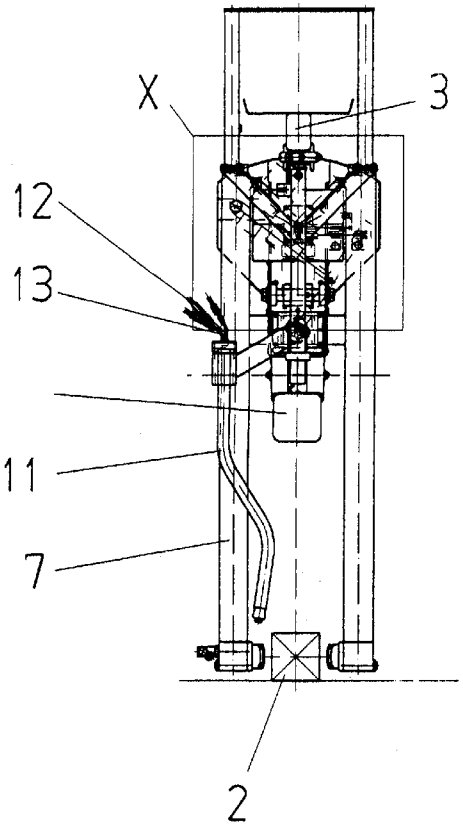
FIG. 7 is a right side view of the portion of the apparatus depicted in FIG. 6.
Figure 8:
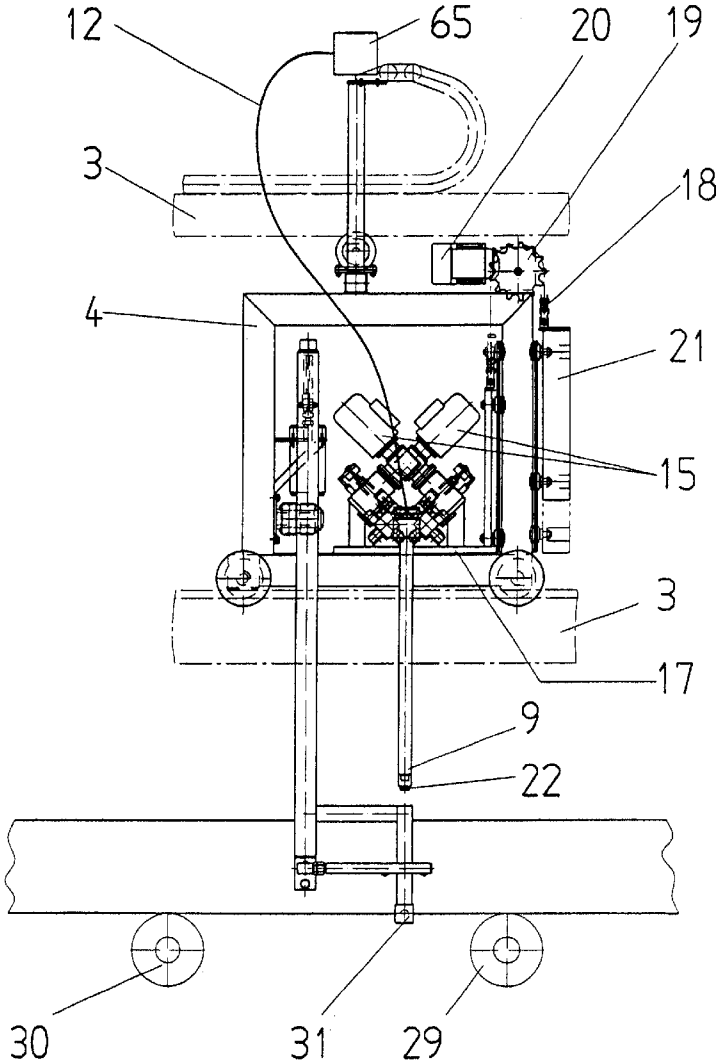
FIG. 8 is a view similar to FIG. 6, except showing a second configuration of a portion of the apparatus in accordance with the present invention.
Figure 9:
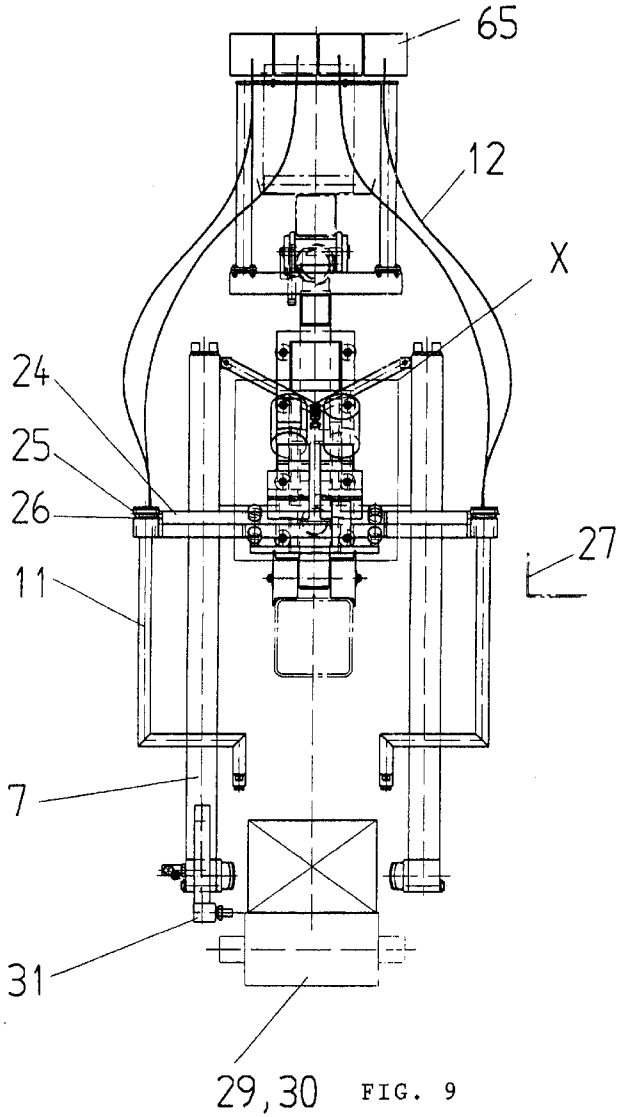
FIG. 9 is a view similar to FIG. 7 except showing a second configuration of a portion of the apparatus in accordance with the present invention.

This accommodation to the strand (2) is effected by a shifting of the saddle (14) by means of the synchronous clamping, by the clamping cylinder (8) vertically acting via a pair of levers (16) onto the clamping levers (8). This is shown in FIGS. 6–7A. As shown in FIGS. 8–11, the saddle (14) is designed as an up-folding or upwarding travelling rocker (17) with lifting chain (18), deflection pulleys 119), lifting drive (20) and counter weight (21), to balance smaller upward lift motions of the strand (2) without any damages. The synchronizing down-sitting of the rocker (17) produces as well the always same nozzle distance as once before adjusted. This applies as well for the gas deburring device (31) fastened to the rocker (17) or the clamp down skid (10), which blows off the still soft and hot cutting burr (41) at the end of the oxygen cutting using compressed air or oxygen. The saddle (14) or the rocker (17) can as well taken out easier from a L-shaped machine frame (4) for repair or maintenance work if it is suitably designed with clamping lever (7) or clamp down skid (10) and cutting drive (15), instead of taking the whole machine out or of their tracks (3).

An additional protection against copying is requested, as to which a water-cooled low shaped or angular burner arm (11) or burner holder (11) or oxygen cutting burner (9) itself not only protectedly contain the utilities supply pipes (13) for the oxygen cutting burner (9) and transfer the oxygen cutting burner motion effected by the cutting drive (1 5) above the water-cooled track (3) onto the oxygen cutting burner (9) underneath the track (3), but as well can be tilted upward with the help of a joint towards a platform by maintenance personal for a regular exchange of the oxygen cutting nozzles (22). Another design of the cutting oxygen burner (9) holding or of the burner arm (11) at the rotating driving shaft (23) or the shifting racktype cutting push bar (24) of the cutting drive (15) shown in FIGS. 12–15, in the easy by a light knock or push releaseable connection between these driving or driven parts of the cutting drive (15) in the form of a fixing cone (25) on the side of the burner, a machine cone with smallest cone angle, which fits into a corresponding conical receiver on the drive side. Of course the arrangement of cone and conical receiver could be made the other way around, corresponding holding parts could be screwed on adjustable, welded, soldered or engaged by a joint.

With one light knock against the thinner part of the fixing cone (25) the cone connection could be released for instance, in order to lift the oxygen cutting burner (9) out from top to exchange it against oxygen cutting burner (9) with a new oxygen cutting nozzle (22) respectively to put the latter one in. A longitudinal guiding key is foreseen to avoid a rotation in strand (2) direction. A conical release ring (26) allows a manual releasing without misaligment.

This exchange from top, from a maintenance platform (27) down, is as well possible during the casting operation, which is very important in emergency cases or during longer lasting casting periods. The cutting push bars (24) shown in FIGS. 8–11 are rack like, solid bars or pipes (13), which engage into pinions of the cutting drives (15) and are driven through their push bar bearings including rollers with cutting speed or fast speed, and carry on their outside end, maybe on both ends an angular burner arm (11) with an oxygen cutting burner (9) or as well an oxygen cutting burner (9) with an angular shaft pipe (13), of which the horizontal portion of its lengths corresponds to the cutting push bar (24) and allows therefore as well the cutting of wide work pieces (2) i.e. slabs. For a time saving counter cutting of two oxygen cutting burners against each other, in casting direction one after the other two cutting drives (15) and two cutting push bars (24) with two oxygen cutting burners arranged, which work in the same line, i.e. on the same cut, having corresponding holders or having bend off shaft pipes (13).

Figure 16:
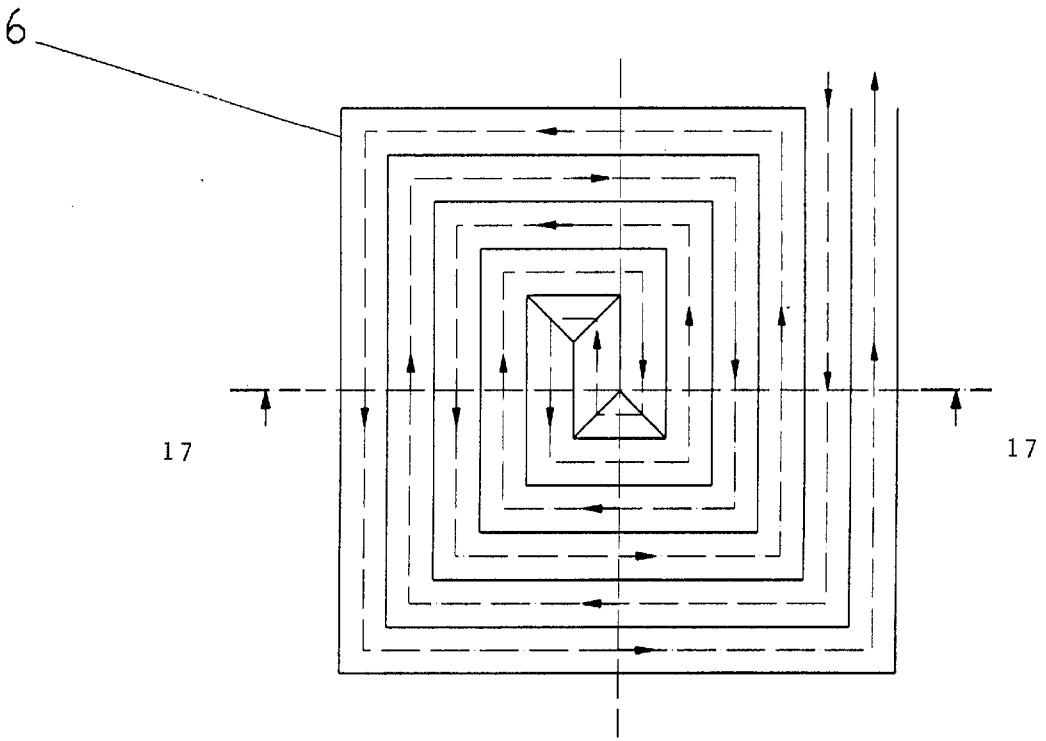
FIG. 16 is a top plan view of a water plate in accordance with the present invention depicting the flow of liquid therethrough.
Figure 17:
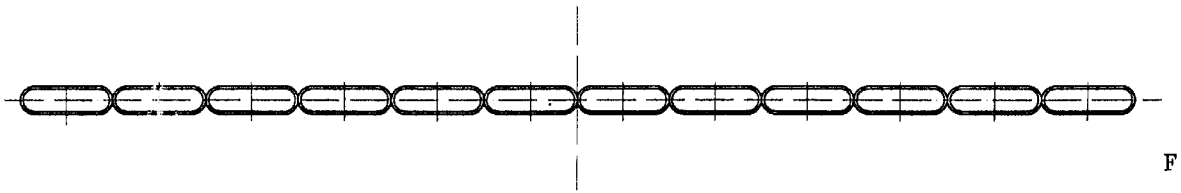
FIG. 17 is a sectional view as taken along lines 17—17 of FIG. 16.

A a special water plate as per FIGS. 16 and 17 advantageous in respect to protection efficiency, versatility and manufacturing cost, consisting of flat, nearly rectangular pipes which are produced by pressing or rolling from normal round pipe into approximately oval shape and welded together into inward and outward turning spirals using trapezoid parts. It is pointed out, that in the middle of the spiral water plate shorter or longer depending on requirements, a parallelogram type is welded in, in order to reverse the direction of the water flow.

Figure 2:
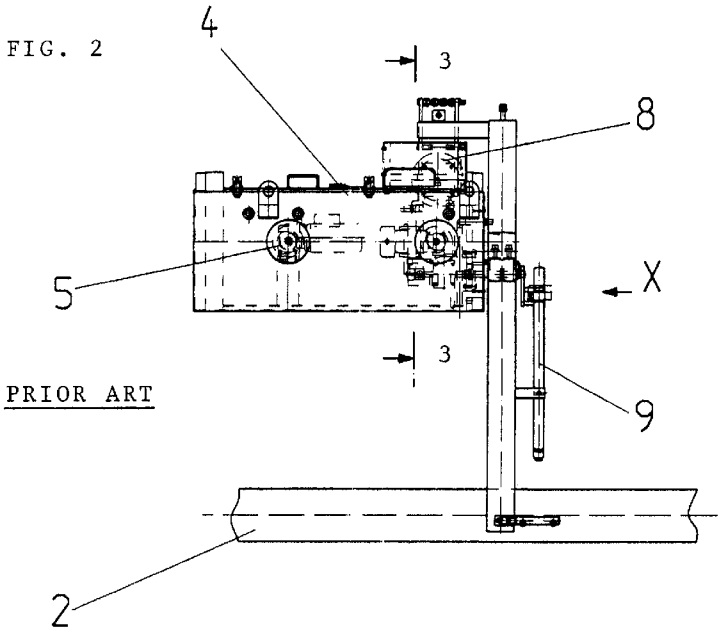
PRIOR ART FIG. 2
FIG. 2 is an enlarged view of a portion of FIG. 1.
Figure 3:
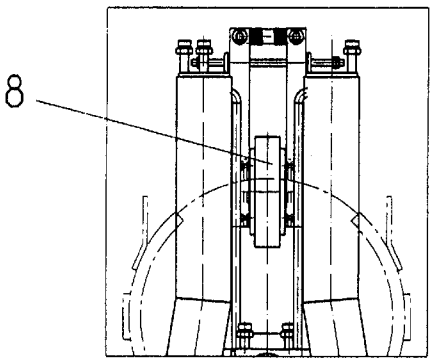
PRIOR ART FIG. 3
FIG. 3 is a sectional view as taken along line 3—3 of FIG. 2.
Figure 5:
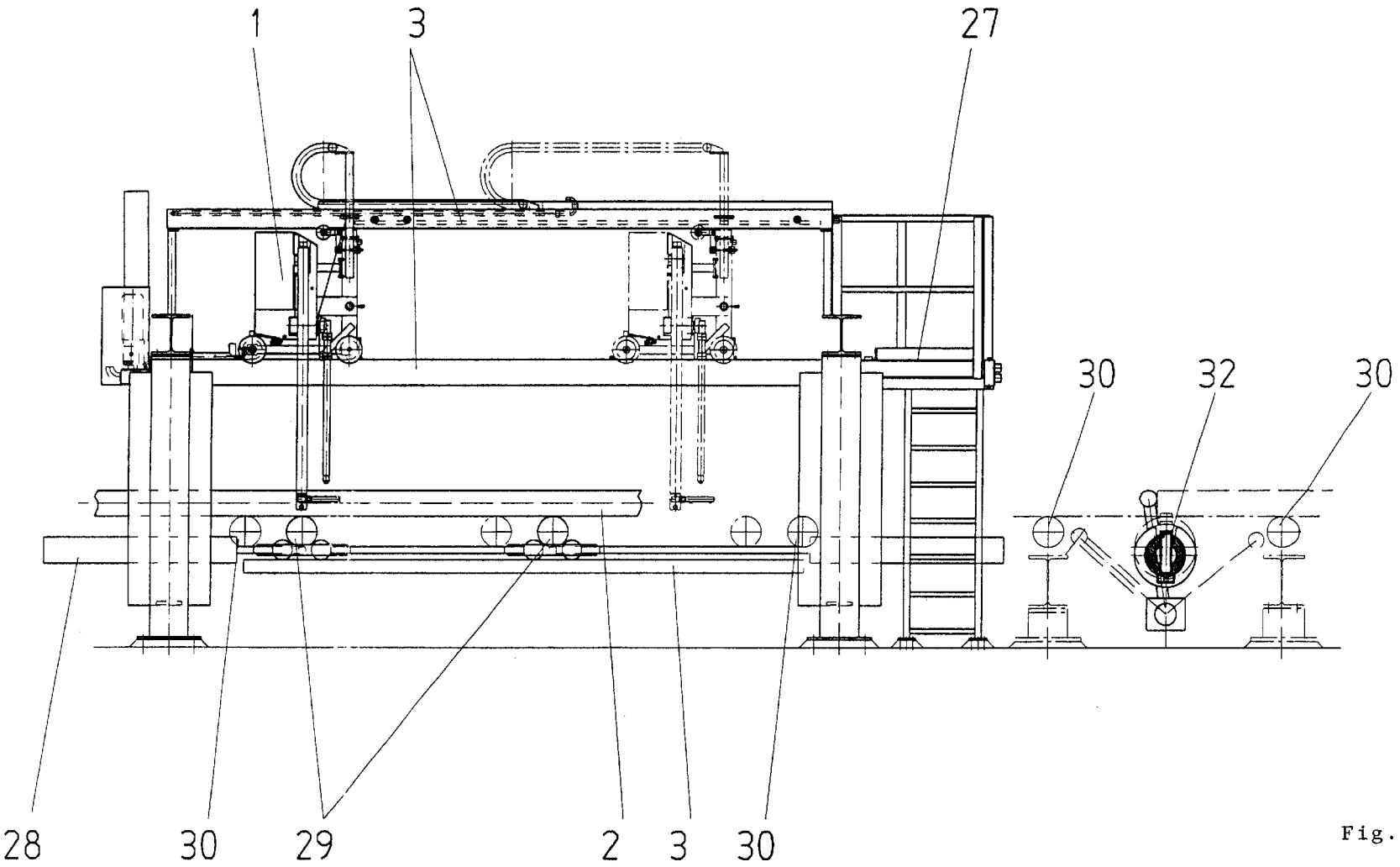
FIG. 5 is a front elevational view of a deburring apparatus in accordance with a first embodiment of the present invention.
Figure 6A:
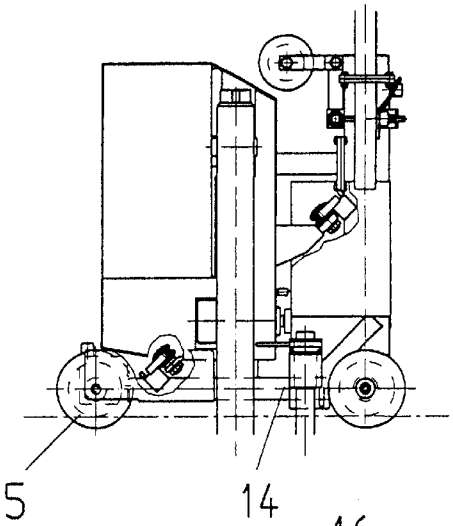
FIG. 6A is an enlarged view of the portion of FIG. 6 enclosed by the box Y.

In FIG. 2 for explanation two support rolls (29), travelling on a common track (3) by two piston drives (28), which together support the work-piece (2) having a very short distance to the last stationary support roll (30) and a normal supporting distance within each other, and a slightly longer than normal support distance to the support roll (30) at the exit side of the work-piece (2) in the cutting area underneath the oxygen cutting machine (1). During synchronous travel between strand (2) and oxygen cutting machine (1) and the cutting the first travelling support roll (29) is moving in front of the oxygen cutting burner (9) to the middle of the cutting area with a speed corresponding to the synchronous travelling, whereas the travelling support roll (29) already in the middle travels in the same fashion towards the end of the cutting area. Subsequently there is no bigger support distance for strand (2) than the original supporting distances. At the end of the oxygen cutting the travelling support rolls (29) return into their starting positions.

Figure 19:
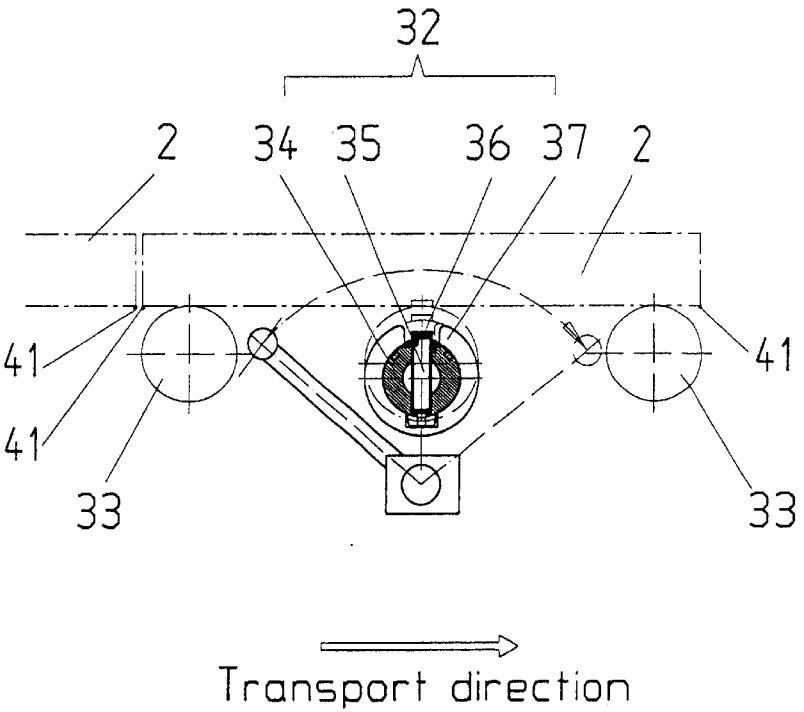
FIG. 19 is a sectional view as taken along line 19—19 of FIG. 18.
Figure 18:
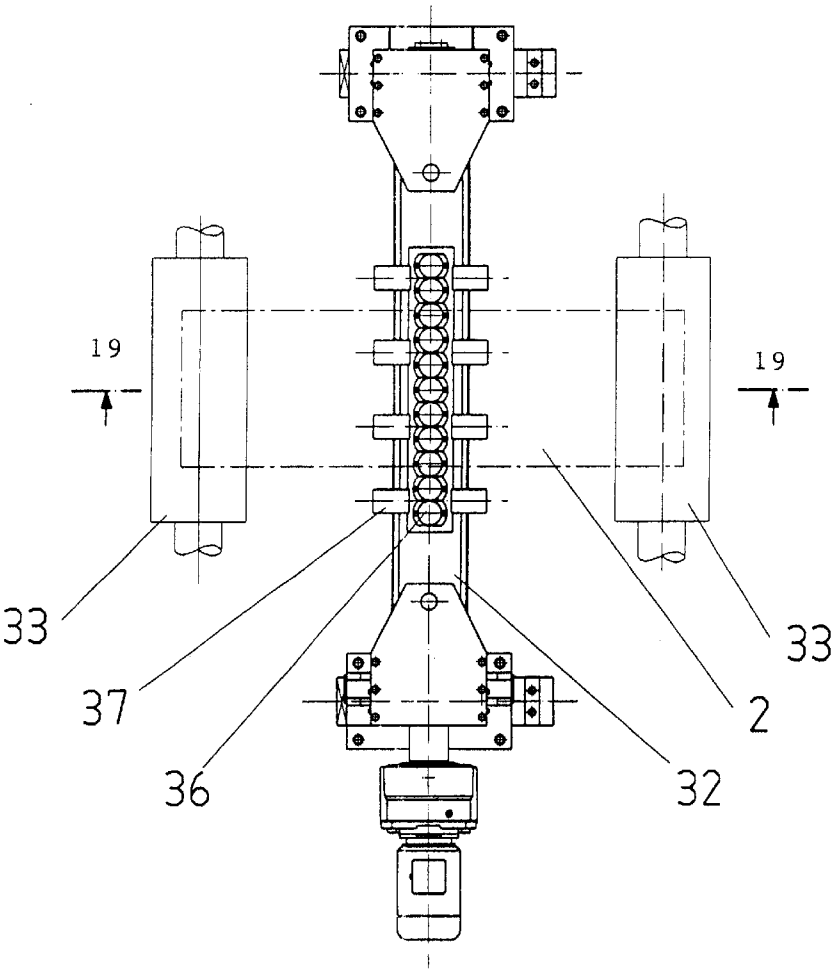
FIG. 18 is a top plan view of a portion of the first embodiment.
Figure 22:
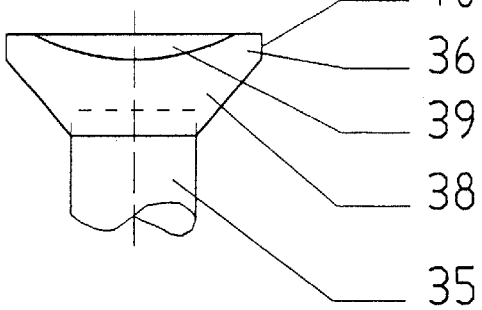
FIG. 22 is a side view of a chisel cap.
Figure 20:
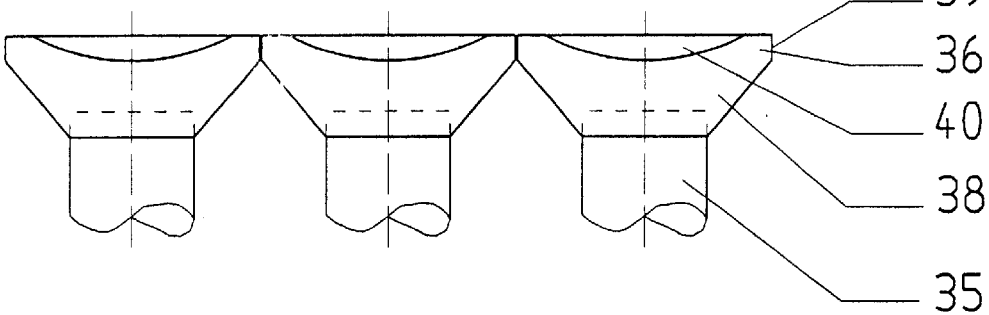
FIG. 20 is a front elevational view of a plurality of chisel caps in accordance with the present invention.
Figure 21:
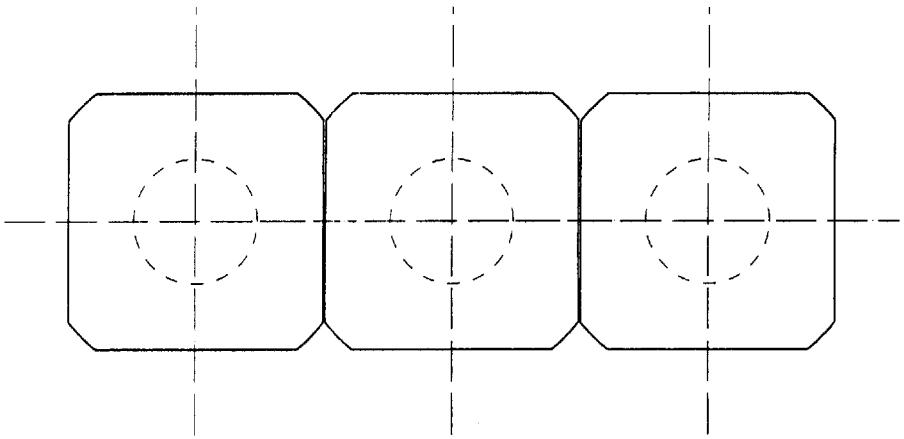
FIG. 21 is a top plan view of the chisel caps.

FIGS. 18–19 shoe a new type roll deburrer (32) arranged behind the oxygen cutting machine (1) which before all are applied for short work pieces (2) to deburr them after being completely separated. In this way it is avoided at lowest expense that these short work pieces (2) tilt or drop into the working gap of a typical deburrer in a roller table gap before or behind this deburrer, because a roller table roll (33) in accordance with the normal roller distance has to be eliminated to install a deburrer as known in practice or from literature. The novel deburrer (32) consists of a conventional pipeshaped piston body (34) into which compressed air or hydraulic lift-and lowerable deburrer pistons (35) are inserted one next to the other. The latter carry special, hardened chisel caps (36). Onto the free piston body (34) a higher wear depending number of travel rings (37) are welded on; this transforms the piston body into a roller table roll (33). In a plain transport case, the roll deburrer (32) can rotate loosely or driven supporting underneath the strand (2), whereby the circumference speed at the travel rings (37) corresponds to the speed of the strand (2) or of the work-piece (2) to be transported after separation. The deburrer pistons (35) can be run out to the travel level of the travel rings (37) to support smoothly or can be retracted.

It is possible of course, to design the piston body (34) with a bigger diameter like a solid roll without travel rings (37), but then the deburrer pistons (35) with the chisel caps (36) are fully retracted into the piston body (34) for transport duty.

For a deburrer process the roll deburrer (32) is moved into an angle position of the deburrer pistons showing towards the end of the work-piece (2) relative to the vertical position, before the entrance of the front or the end of the work-piece (2), so that they stand vertical or similar, after the synchronized travel of a distance defined by an acceleration distance plus the burr width. In this starting position the roll deburrer (32) is stopped together with the work, piece (2) and interlocked. The deburrer pistons (35) are run out until the chisel caps (36) press securely against the lower surface of the work-piece (2). Now the work-piece (2) with its burr (41) is travelled by the moving roller table rolls (33) or with the help of another known shifting device, i.e. by a pinch roll pressed on from top, against the stationary roll deburrer (32) and deburred. The deburring of the other end is performed accordingly. Instead of an expensive pinch roll pressed on from top, one end of the work-piece (2) with its burr (31) can be pushed against and over the roll deburrer (32) by a pusher which is a bar with a roll, rotated around the roll deburrer (32) by a motor drive. For reasons of the power requirements, of safe deburring as well of smallest only flipped up pieces of the oxygen cutting burr (41) and of the wear of chisel caps (36), shape and weight of the latter are of highest importance, with only round chisel caps (36) which are the most economical solution in production and weight, the penetration of small rests of the oxygen cutting burr (41) into the small gaps between two chisel caps (36) each and the resulting jamming when moving up and down are of high importance for a high deburring rate by a safe deburring and a knocking-off of the flipped up rests of the cutting burr (41) by jumping up when leaving the lower surface, by the unfortunately not parallel with the end edge of the chisel caps (36) formed chisel caps (36). For this reason and shown in the FIGS. 20–28, chisel caps are designed, which originally were rectangular plates, but were formed as a cone (38) from the lowest end with approximately the diameter of the deburrer piston (35) and increasingly to a bigger diameter, which at least rounds off the corners of the rectangular edges.

As far as not already given by the original dimensions, on two sides guiding faces (39) should be machined on, which at the same height position of neighbouring chisel caps (36) prevents a rotation of them against each other.

The other two top sides are formed to be chisel faces (40) with suitable chisel angle. Should one of the chisel caps (36) rotate at a different heights during the deburring work, it will rotate back into its working position by its side guiding face (39) pressing against the neighbouring deburrer piston (35) or cone (38) when travelling up and down.

Figure 24:
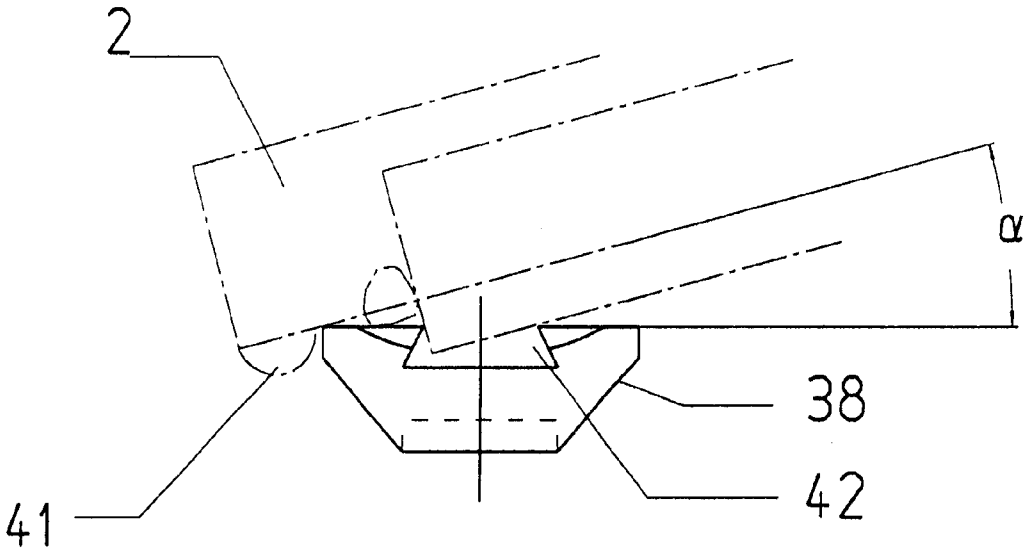
FIG. 24 is a side view of the second type of chisel cap in operation.
Figure 23:
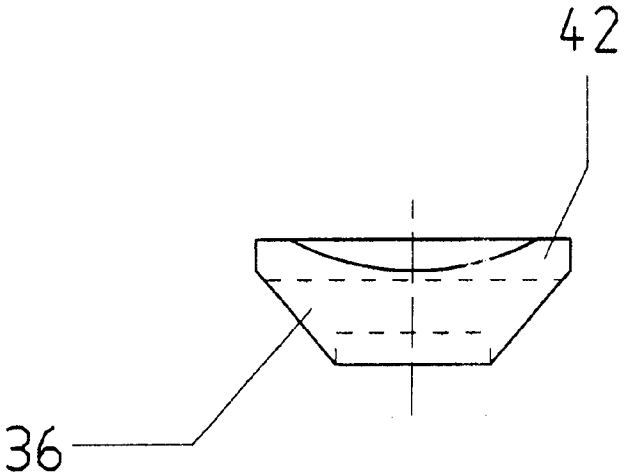
FIG. 23 is a front elevational view of a second type of chisel cap in accordance with the present invention.
Figure 25:
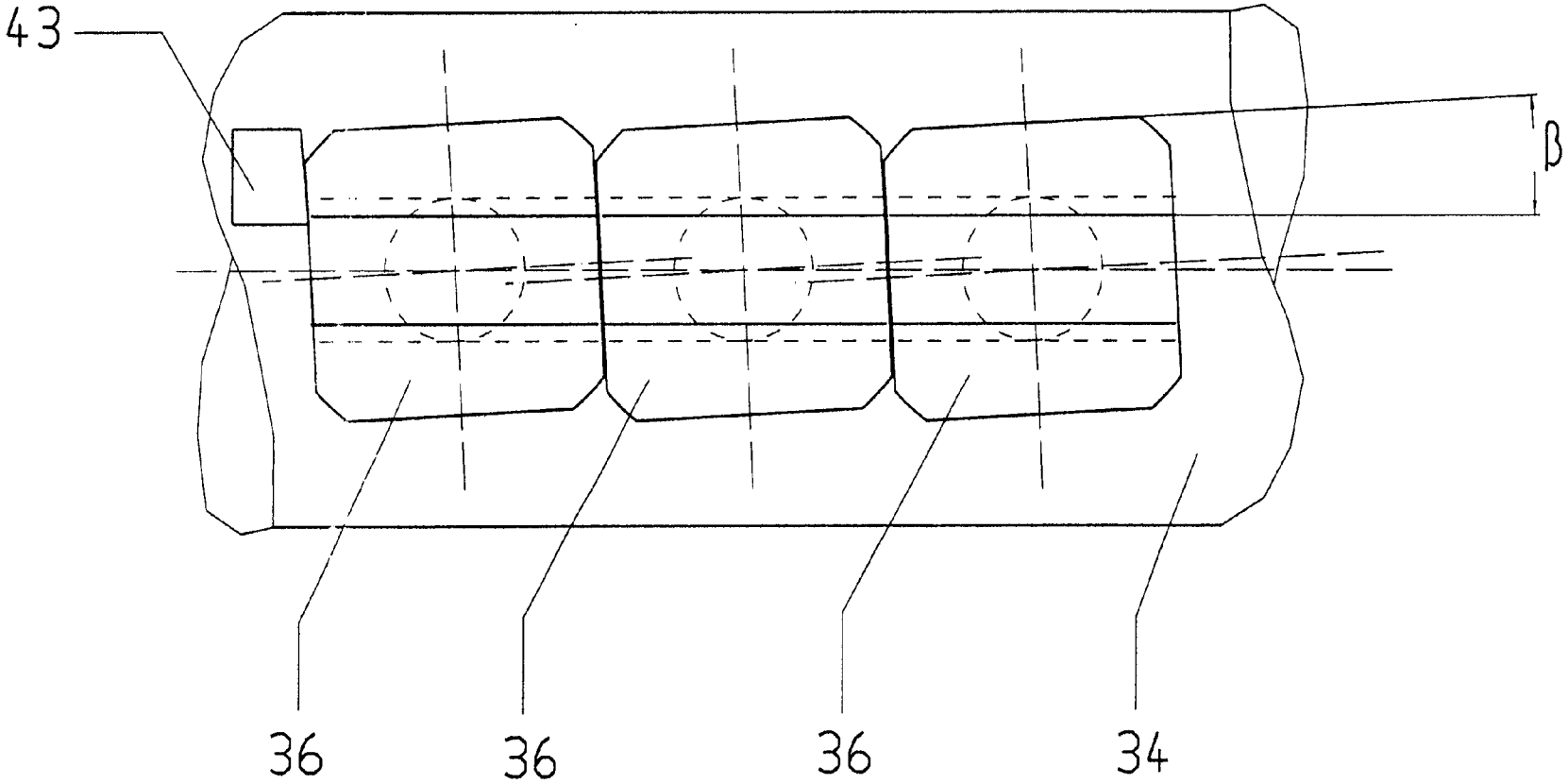
FIG. 25 is a top plan view of a plurality of the second type of chisel cap.

As the whole piston body (34) and with it all chisel caps (36) have a free flank angle a relative to the lower face of the work piece (2), it is advantageous to effect a first jumping up of the chisel cap (36) when travelling over a scraping groove (42) machined into the middle of the chisel cap (36) and subsequently a first knocking-off of flipped up parts of the oxygen cutting burr (41). A further jumping up occurs when the chisel cap (36) has passed the work piece (2) fully as shown in FIGS. 23 and 24. The now predominantly straight form of the chisel face (40) as well that of the scraping groove (42), which does not leave any bigger gap for rests of the oxygen cutting burr (41) to slip through at the end of the work-piece (2). Moreover the scraping groove (42) designed in dove-tail fashion as second chisel face (40) can pick up rests of the oxygen cutting burr (41). The gaps between the chisel cap (36) intented or developped involuntarily by manufacturing tolerances allow a rotation into a working position limited by a stop showing a working flank angle $\alpha$ like in FIG. 25, which helps to reduce the original deburring force. Of course, the scraping groove (42) should have the same sized angle $\alpha$ to ensure a successful scraping.

To increase the sit-on pressure from down to up to avoid a slipping of the chisel cap (36) over a flat oxygen cutting burr (41) in comparison to the force applied, flat pressure grooves (44) as shown in FIGS. 26–28 are suggested.

Figure 29:
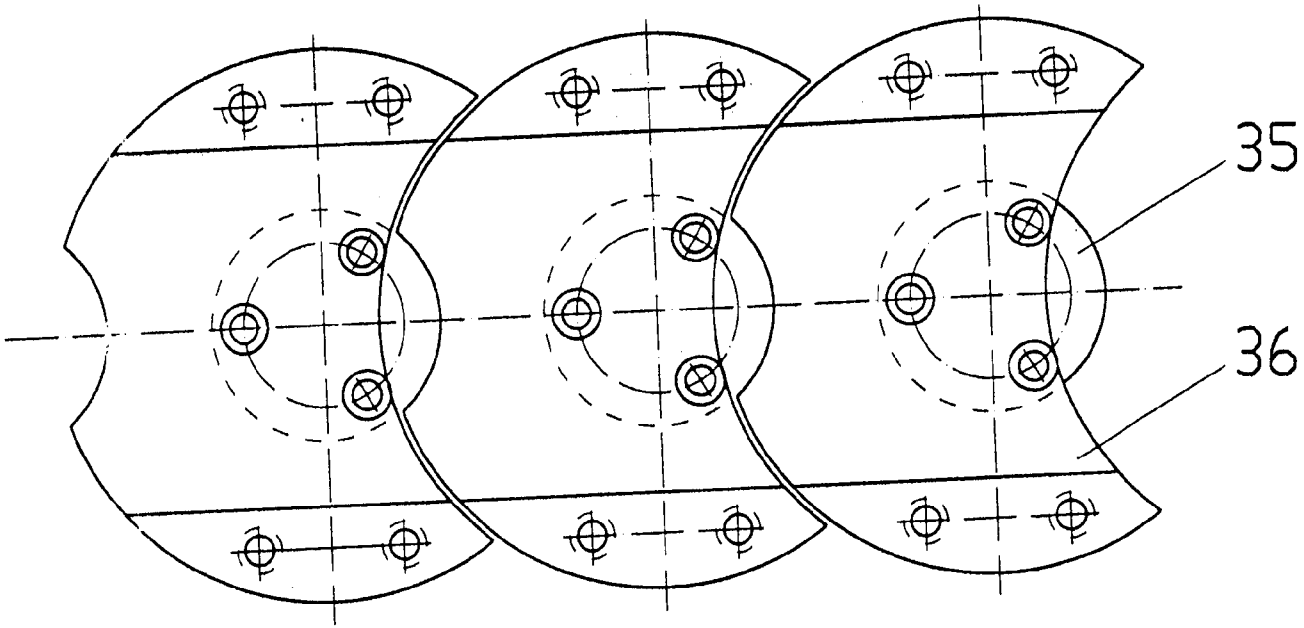
FIG. 29 is a top plan view of a plurality of a fourth type of chisel cap in accordance with the present invention.

In FIG. 29 a similar chisel cap (36) is shown, which has two cut-outs being a round chisel cap (36), once on the left side like a little half moon cut-out for guiding along the neighbouring deburrer piston (35) to serve as a twist protection in the piston range and right hand side a bigger cut-out for guiding along the neighbouring round chisel cap (36) at its level.

Figure 32:
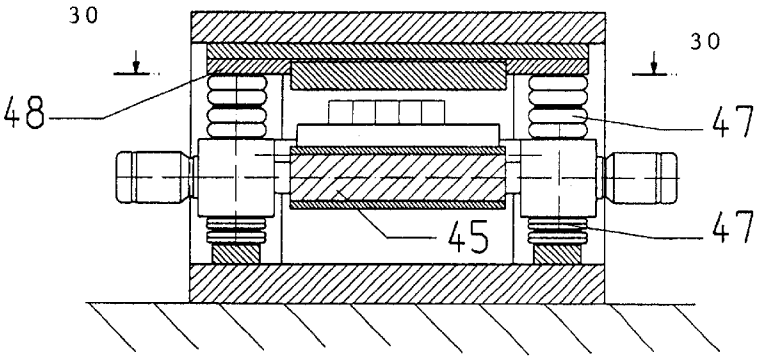
FIG. 32 is a sectional view as taken along line 32—32 of FIG. 31.
Figure 31:
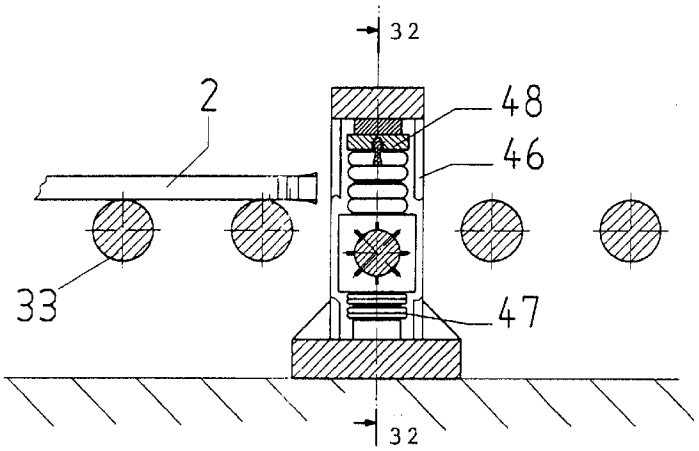
FIG. 31 is a sectional view as taken along line 31—31 of FIG. 30.
Figure 30:
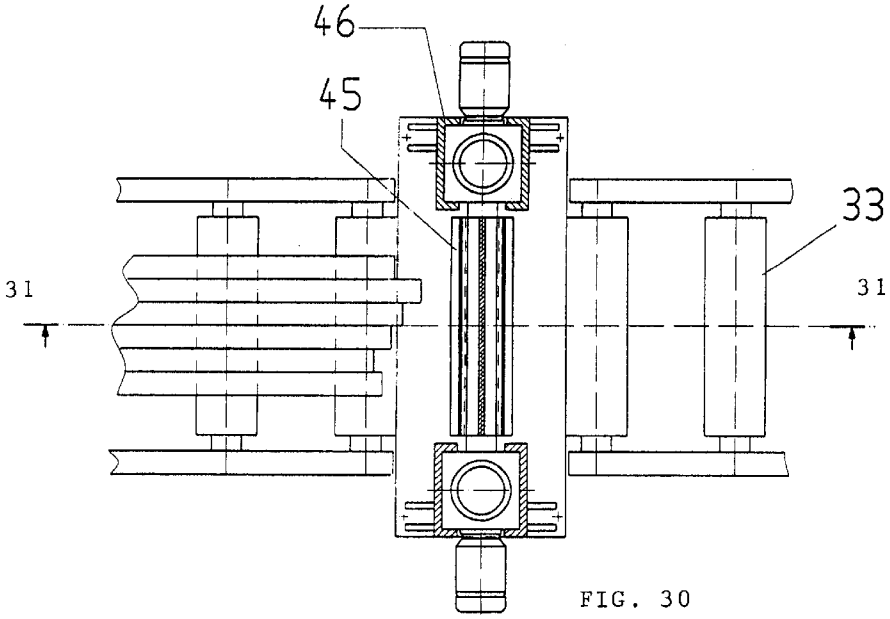
FIG. 30 is a top plan view of a portion of a second embodiment of a deburring apparatus in accordance with the present invention as taken along line 30—30 of FIG. 32.

In FIGS. 30–32 a novel, downstream installed roll deburrer (2) with blades is presented, of which the deburrer drum (45) can be lifted in sections (46) arrange on its sides by means of bellow cylinders (47) and at that so high that all in irregular fashion on a common roller table arriving, possibly bent strands (2) than with close oxygen cutting burr (41) are arranged at the same height level. Then the deburring process is initiated by rotating the deburrer drum (45). Before that however a stopper bar (48) has to keep the incoming strand pieces (2) in down position at the same location and as well fixed during deburring. After lifting the stopper bar (48) the onward transport is possible.

Figure 33:
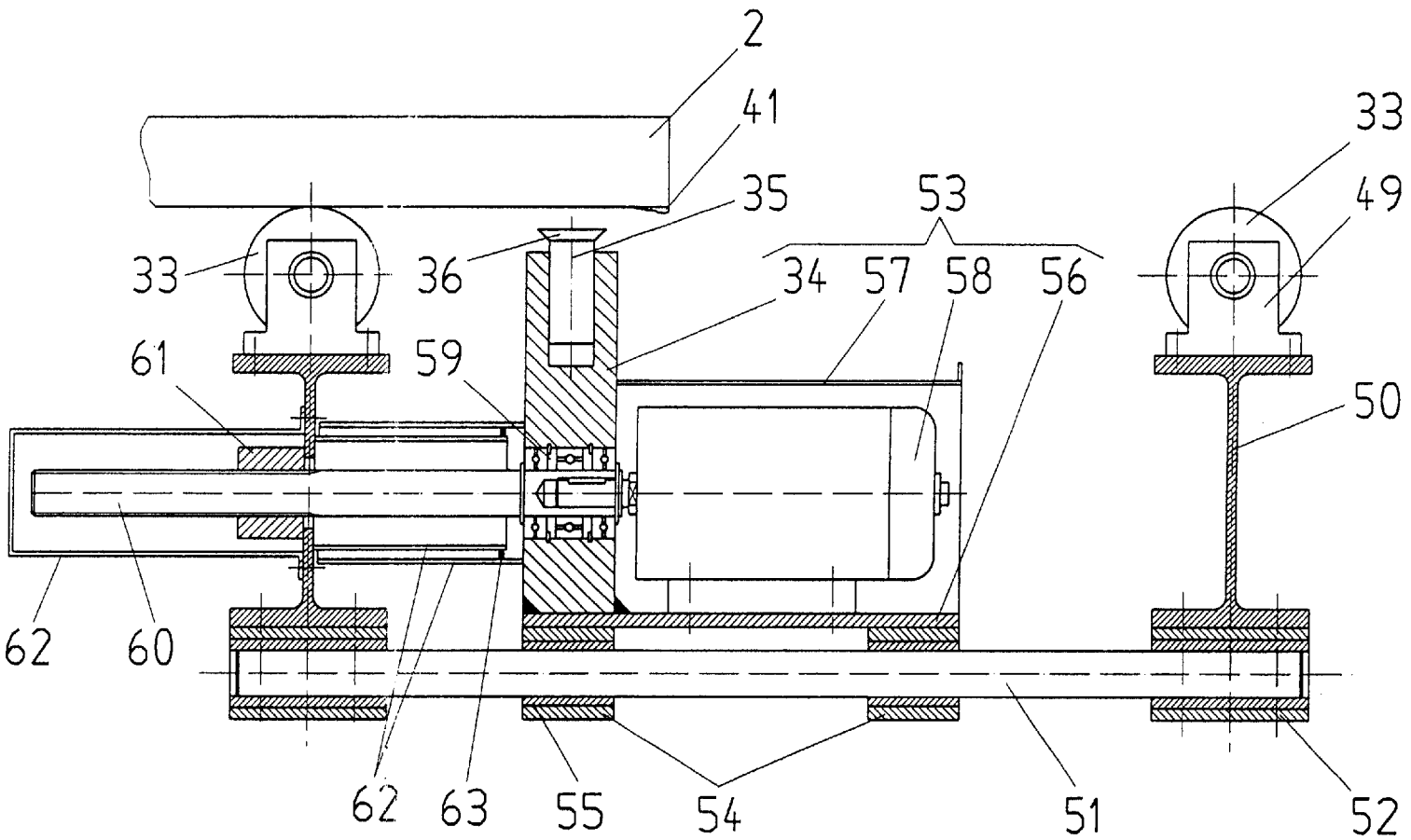
FIG. 33 is a front elevational view, partially cut away, of a portion of a third embodiment of a deburring apparatus in accordance with the present invention.
Figure 34:
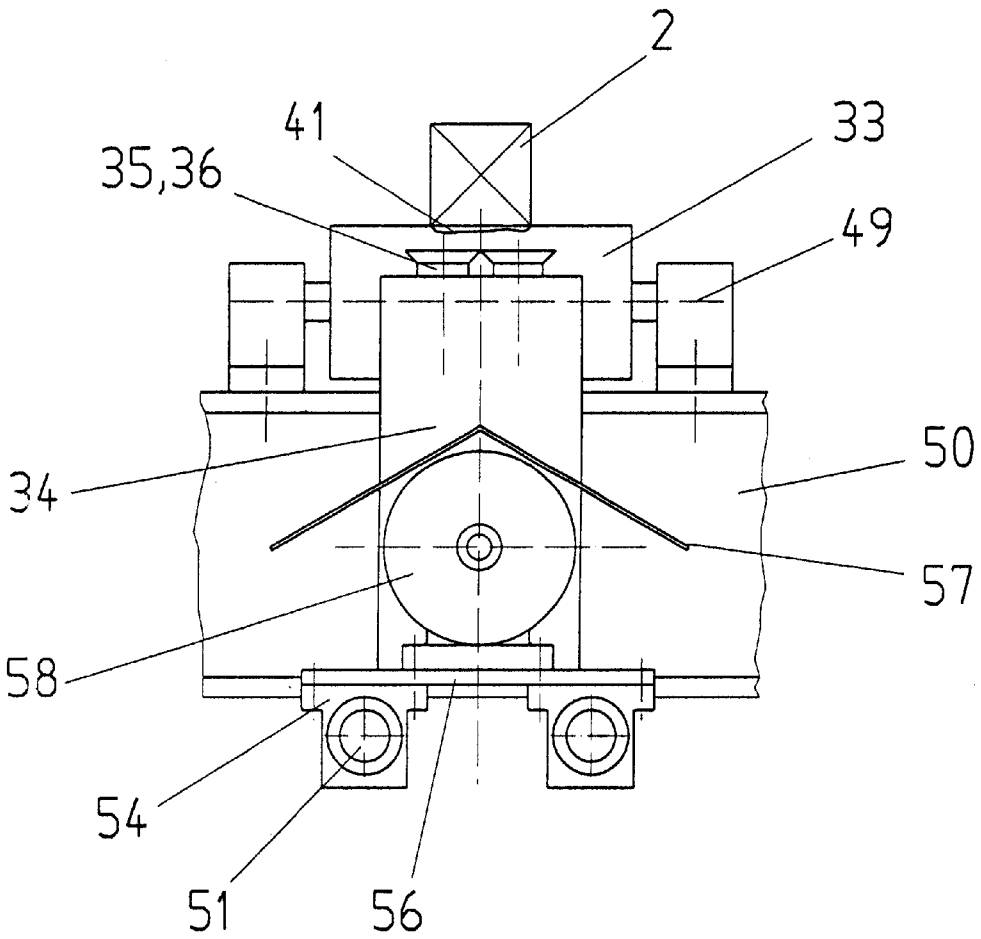
FIG. 34 is a right side view of the subject matter of FIG. 33.
Figure 35:
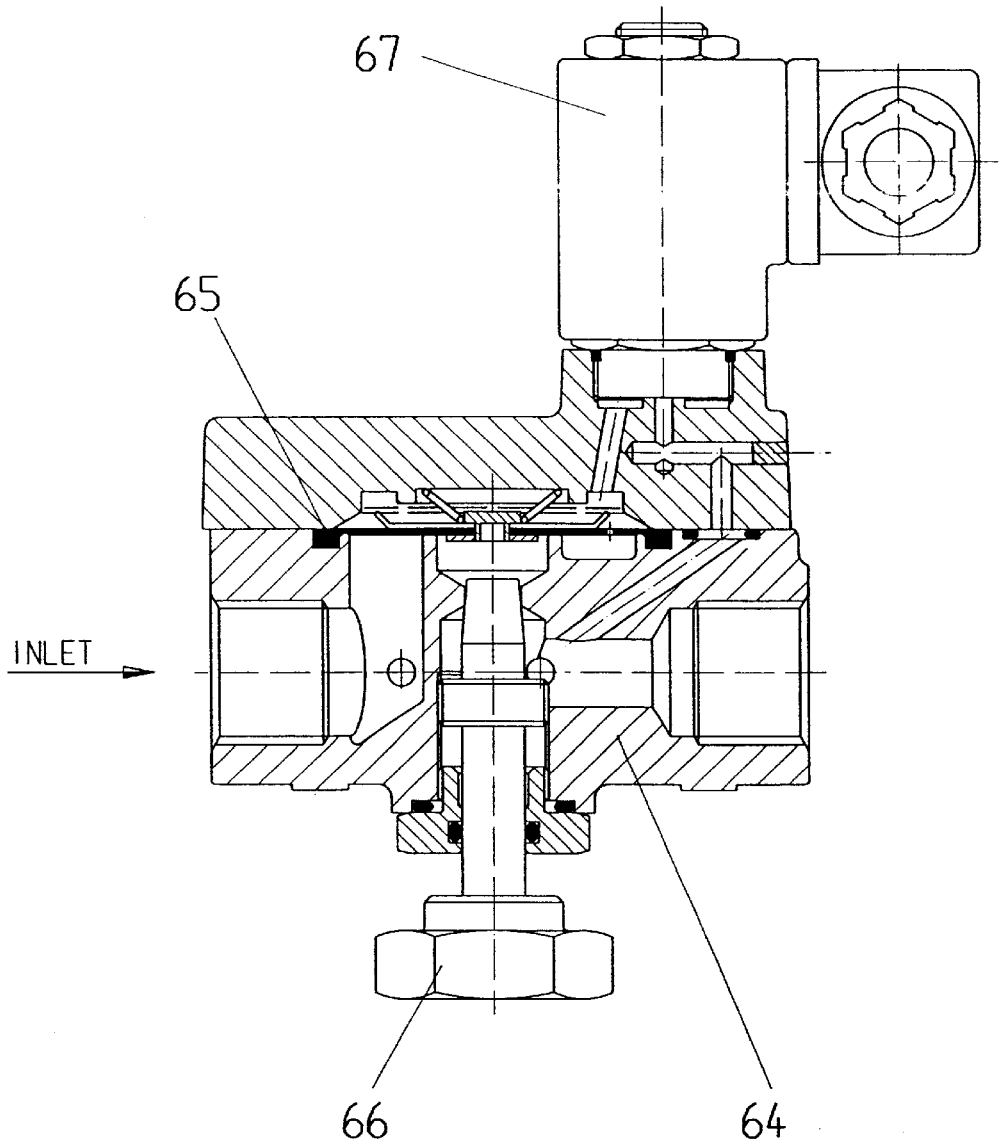
FIG. 35 is a view of a regulating system in accordance with the present invention, partially cut away.

As per FIG. 33 a further, novel slide deburrer (53) for individual work pieces (2) on individual roller tables using linear deburring movements, travelling against the oxygen cutting burr (41) or overtaking it in a short roller table gap is shown. Underneath a work-piece (2) and its oxygen cutting burr (41) transported out of a continuous casting plant via roller table rolls (33) with roller bearings (49), a slide deburrer (53–60) with glide bearings (54) and glide bushes (55) is arranged on two glide bars (51) fixed by 4 glide bar holders (52) on the roller table frame (50) in a gap between two roller table rolls (33). For deburring both oxygen cutting burrs (41) at the beginning and at the end of each work piece (2) a motor (58) with brake moves or holds the lifting and lowering deburrer pistons (35) with chisel caps (36) sitting in the piston body (34) on the slide base (56) protected by a slide roof (57) via a rotatable push or pull producing spindle (60) in a spindel nut (61) it its protection pipe (62) fastened to the roller table frame (50) and to the deburrer slide (53) with the glide bearings (54) with glide bushes (55). The protection pipes (62) of different diameter with an intermediate dust ring (63) can be shifted against each other and are kept under inside pressure for cleanliness and greasing by compressed air existing from the piston body (34).

This simple design of a deburrer including the roller table frame (50) facilitates the installation with short roller table gaps with the maximum use for a longest shifting path possible. The spindle nut (61) could as well be installed on the other side of the cross girder of a roller table frame (50) to increase this shifting path. A reverse arrangement of spindle nut (61) and motor (58) is possible, too. The spindle (60) replaces with its pitch a reduction gear or parts of it to improve the deburring force and can absorb well high surface pressure with gliding or rolling friction, as well known from spindle presses.

I claim:

1. An apparatus for the cutting and deburring of a plurality of workpieces from a metal strand, the apparatus comprising:

an upper track;

a lower track disposed below the upper track; the lower track being liquid-cooled;

a frame mounted on the upper and lower tracks;

at least a first oxygen cutting machine including at least a first cutting burner, the at least first cutting burner being removably mounted on the frame and including a regulating system comprising a mass flow controller wherein the at least first cutting burner selectively produces a strong initial cutting flame and a weak normal cutting flame, the at least first oxygen cutting machine being free of structures extending below the lower track other than the at least first cutting burner;

at least a first upper wheel and at least a first lower wheel being mounted on the frame, the at least first upper wheel being rollably disposed on the upper track, the at least first lower wheel being rollably disposed on the lower track;

a first gas deburring device mounted on the frame;

a second deburring device structured to operatively interact with the workpieces;

a saddle adjustably mounted on the frame;

a clamping apparatus operationally mounted on the saddle and operationally driven by a clamping drive; and at least a first cutting drive mounted on the saddle, the at least first cutting drive operationally moving the at least first cutting burner.

2. The apparatus as set forth in claim 1, in which the clamping apparatus is a clamp down skid mounted on the frame, the saddle being at least nominally shiftable by the clamp down skid.

3. The apparatus as set forth in claim 1, in which the at least first cutting drive operationally moves the at least first cutting burner with a pendulum motion.

4. The apparatus as set forth in claim 1, in which the at least first cuffing drive operationally moves the at least first cutting burner with a translational motion.

5. The apparatus as set forth in claim 1, in which the saddle is height-adjustable by one of a motor, a hydraulic drive, and a pneumatic drive.

6. The apparatus as set forth in claim 1, in which the saddle is at least nominally shiftable by the clamping apparatus.

7. The apparatus as set forth in claim 1, in which the frame is one of a box configuration, a channel configuration, and an L-shaped configuration.

8. The apparatus as set forth in claim 1, further comprising a second cutting drive mounted on the saddle and a second cutting burner, the second cutting drive operationally moving the second cutting burner.

9. The apparatus as set forth in claim 1, in which the at least first cutting burner cuts vertically.

10. The apparatus as set forth in claim 1, in which the at least first cutting burner cuts horizontally.

11. The apparatus as set forth in claim 1, in which the second deburring device includes a plurality of retractable chisel caps and a pusher.

12. The apparatus as set forth in claim 1, in which the second deburring device includes a deburrer drum and a stopper bar, the deburrer drum including at least a first blade.

13. The apparatus as set forth in claim 1, in which the second deburring device includes a motor, a spindle, a spindle nut, a deburrer slide, a deburrer piston and a deburrer chisel mounted on the deburrer slide, and at least a first glide bar, one of the spindle and the spindle nut being operationally mounted on the motor, the spindle and spindle nut cooperating with one another to reciprocate the deburrer slide along the at least first glide bar in response to rotational movements of the motor.

14. The apparatus as set forth in claim 1, further comprising a guiding system movably mounted on the upper track and a holder that carries equipment for the supply of gas, liquid, and iron powder, the equipment for the supply of gas including a flow sensor and a pressure sensor.

15. The apparatus as set forth in claim 14, in which the oxygen cutting machine is protected by at least a first liquid plate, each liquid plate being configured with an inward-turning spiral and an outward-tuning spiral welded to one another, the spirals being formed of pipes having a substantially oval-shaped cross section.

16. The apparatus as set forth in claim 15, in which the clamping apparatus is a clamp down skid, and further comprising a lifting carriage, the saddle being disposed on the lifting carriage, the lifting carriage being vertically movable with respect to the frame, the clamp down skid being selectively engagable with the strand, the clamp down skid engaged with the strand maintaining a predetermined distance between the at least first cutting burner and the strand.

17. The apparatus as set forth in claim 15, in which the clamping apparatus is a pair of clamping levers, and in which the clamping drive is a vertical cylinder, the clamping levers being synchronously operable by the vertical cylinder, and further comprising a pair of connecting levers operationally extending between the clamping levers and the vertical cylinder, the at least first oxygen cutting machine being operationally centered over the strand and translating in conjunction therewith when the clamping levers are clamped against the strand.

18. The apparatus as set forth in claim 17, in which the at least first oxygen cutting machine further includes a quick-release mechanism allowing the at least first cutting burner to tilt for rapid removal from the apparatus, and in which the at least first cutting burner is liquid-cooled and includes a utility supply pipe disposed therein, the at least first cutting burner extending at least partially around the lower track and being moved with a pendulum-like motion by the at least first cutting drive, the at least first cutting drive being disposed on one of the saddle and a rocker disposed on the frame.

19. The apparatus as set forth in claim 18, in which the quick-release mechanism is a joint.

20. The apparatus as set forth in claim 18, in which the quick-release mechanism is a hinge.

21. The apparatus as set forth in claim 18, further comprising at least a first push bar formed with a rack, and in which the at least first cutting drive operatively engages the rack to selectively translate the at least first push bar, the at least first cutting burner including an L-shaped burner arm mounted on the at least first push bar and extending below the lower track.

22. The apparatus as set forth in claim 21, in which the quick-release mechanism is a fixing cone disposed on the at least first cutting burner and a receiving cone disposed on one of the at least first cutting drive or the at least first push bar, the fixing cone being detachably received in the receiving cone.

23. The apparatus as set forth in claim 22, further comprising a parallelogram-shaped piece of pipe extending between the inward-turning spiral and the outward-turning spiral of the at least first liquid plate.

24. The apparatus as set forth in claim 23, in which the second deburring device includes a rotatable piston body carrying a plurality of deburring pistons, each deburring cap including a chisel cap, the deburring pistons being movable between extended and retracted positions, the piston body further including a plurality of traveling rings disposed thereon and interrupted in the area of the deburring pistons, and further including a push bar having a rotatable push roller disposed thereon at one end thereof and including a push bar drive operatively connected with the push bar, the push bar being tiltable by the push bar drive around the piston body.

25. The apparatus as set forth in claim 24, in which each chisel caps is manufactured out of a wear-resistant material, the chisel caps being disposed closely adjacent one another.

26. The apparatus as set forth in claim 25, in which each chisel cap includes a generally polygonal upper face that is structured to deburringly engage the workpieces, the chisel caps each being of a generally frusto-conic shape in the transition zone extending between the polygonal upper surface and the associated deburring piston.

27. The apparatus as set forth in claim 26, in which each chisel cap is formed with at least a first scraping groove and at least a first pressure groove.

28. The apparatus as set forth in claim 25, in which each chisel cap is formed with a first half-moon face and a second half-moon face.

29. The apparatus as set forth in claim 28, in which each chisel cap is formed with at least a first scraping groove.

* * * * *